US011719417B1

(12) United States Patent
Lu et al.

(10) Patent No.: US 11,719,417 B1
(45) Date of Patent: Aug. 8, 2023

(54) LAMP TUBE STRUCTURE CAPABLE OF PREVENTING GLUE FROM OVERFLOWING

(71) Applicant: Xiamen PVTECH Co., Ltd., Fujian (CN)

(72) Inventors: Fuxing Lu, Fujian (CN); Rongtu Liu, Fujian (CN); Honggang Sun, Fujian (CN)

(73) Assignee: Xiamen PVTECH Co., Ltd., Fujian (CN)

( * ) Notice: Subject to any disclaimer, the term of this patent is extended or adjusted under 35 U.S.C. 154(b) by 0 days.

(21) Appl. No.: 17/981,487

(22) Filed: Nov. 7, 2022

(30) Foreign Application Priority Data

Jul. 14, 2022 (CN) ..... 202210834044.9

(51) Int. Cl.
*F21K 9/272* (2016.01)
*F21V 17/10* (2006.01)
*F21S 4/28* (2016.01)

(52) U.S. Cl.
CPC ..... *F21V 17/101* (2013.01); *F21K 9/272* (2016.08); *F21S 4/28* (2016.01)

(58) Field of Classification Search
CPC ..... F21V 17/101
See application file for complete search history.

(56) References Cited

U.S. PATENT DOCUMENTS 5,188,451 A * 2/1993 Shanks ..... H01J 61/70 362/294
8,456,075 B2 * 6/2013 Axelsson ..... H01J 61/34 313/318.1
2012/0051038 A1 * 3/2012 Yue ..... F21K 9/272 362/218
2012/0069583 A1 * 3/2012 Wang ..... F21K 9/272 362/372
2013/0301255 A1 * 11/2013 Kim ..... F21K 9/27 362/218
2014/0153231 A1 * 6/2014 Bittmann ..... F21V 17/101 362/382

(Continued)

FOREIGN PATENT DOCUMENTS

JP WO 2014/006805 * 1/2014 ..... F21S 2/00

OTHER PUBLICATIONS

English Machine translation of WO 2014/006805 provided by Espacenet (Year: 2014).*

*Primary Examiner* — Zheng Song
(74) *Attorney, Agent, or Firm* — Winston Hsu

(57) ABSTRACT

A lamp tube structure capable of preventing glue from overflowing includes a hollow tube body and a cap body. The cap body covers the opening of the hollow tube body. The inner surface of the cap body has a plurality of ring-shaped protrusion portions arranged to be parallel with each other. The glue is distributed over the inner surface of the cap body and the protrusion portions can prevent the glue from overflowing. The outer surface of the hollow tube body contacts the protrusion portions. The protrusion portions inside the cap body can avoid that the glue overflows from the gap between the cap body and the hollow tube body in order to improve tightness. Thus, the contact area between the glue and the inner wall of the cap body can increase, so the cap body and the hollow tube body can be firmly fixed with each other.

9 Claims, 8 Drawing Sheets

(56) References Cited

U.S. PATENT DOCUMENTS

| | | | | |
|---|---|---|---|---|
| 2016/0290598 | A1* | 10/2016 | Jiang | F21V 7/24 |
| 2019/0203916 | A1* | 7/2019 | Yao | F21V 7/005 |
| 2019/0309909 | A1* | 10/2019 | He | F21K 9/272 |
| 2020/0232608 | A1* | 7/2020 | Wang | F21K 9/272 |

* cited by examiner

LAMP TUBE STRUCTURE CAPABLE OF PREVENTING GLUE FROM OVERFLOWING

BACKGROUND OF THE INVENTION

1. Field of the Invention

The present invention relates to a lamp tube structure, in particular to a lamp tube structure capable of preventing glue from overflowing.

2. Description of the Prior Art

Lighting devices are indispensable for people. People need to use lamps no matter day or night. Lighting devices are usually used for lighting purpose or decorative purpose in many occasions. Therefore, the application of lighting device is already very comprehensive, such as wall lamps, table lamps, lighting lamps, or decorative lamps.

A currently available LED lamp tube includes a lamp tube body and two lamp caps installed at the two ends of the lamp tube body. If the connection interfaces between the lamp tube body and the lamp caps fail to be effectively sealed, water and dust may enter the lamp tube body, which will reduce the service life of the LED lamp tube.

The lamp tube body and the lamp caps of the currently available LED lamp tube are bonded with each other via the glue. However, since the glue may not be uniformly distributed between the lamp tube body and the lamp caps, there may be a gap between the lamp tube body and the lamp caps. Thus, external moisture may enter the lamp tube body via the gap, which may damage the circuits inside the lamp tube body and influence the waterproofness of the LED lamp tube. Besides, the control unit inside the lamp cap may be disconnected from the circuit board or short-circuit may be incurred when the user rotates the lamp cap. Accordingly, the structure of the currently available LED lamp tube still needs to be further improved.

SUMMARY OF THE INVENTION

To achieve the foregoing objective, the present invention provides a novel lamp tube structure capable of preventing glue from overflowing, which includes a hollow tube body and a cap body. The cap body covers the opening of the hollow tube body and the inner surface of cap body is provided with a plurality of ring-shaped protrusion portions arranged to be parallel to each other. The glue is distributed over the inner surface of the cap body and the protrusion portions can prevent the glue from overflowing. The outer surface of the hollow tube body contacts the protrusion portions.

In one embodiment of the present invention, the protrusion portions include a first protrusion portion and a second protrusion portion. The first protrusion portion is disposed at the inner surface of the cap body to form a circle. The second protrusion portion is disposed at the inner surface of the cap body to form a circle. The cross-sections of the first protrusion portion and the second protrusion portion are conical.

In one embodiment of the present invention, the protrusion portions are adjacent to the opening of the cap body.

In one embodiment of the present invention, the inner surface of the cap body includes a plurality of areas. The protrusion portions include a first protrusion portion and a second protrusion portion. There is a first area between the first protrusion portion and the bottom of the inner space of the cap body. There is a second area between the first protrusion portion and the second protrusion portion. There is a third area between the opening of the cap body and the second protrusion portion.

In one embodiment of the present invention, there is a first distance between the first protrusion portion and the bottom of the inner space of the cap body. There is a second distance between the second protrusion portion and the first protrusion portion. The first distance is greater than the second distance.

In one embodiment of the present invention, there is a third distance between the opening of the cap body and the second protrusion portion. The third distance is greater than the second distance.

In one embodiment of the present invention, the inner surface of the cap body is provided with the rough surface and the glue adheres to the rough surface.

In one embodiment of the present invention, the rough surface is distributed over the first area and the second area.

In one embodiment of the present invention, the inner wall of the lamp cap is provided with a plurality of ribs and the outer surface of the hollow tube body contacts the ribs.

In one embodiment of the present invention, the inner wall of the lamp cap is provided with a plurality of positioning blocks and the outer wall of the opening of the hollow tube body contacts the positioning blocks. To sum up, in one embodiment, the protrusion portions inside the cap body can prevent the glue from overflowing out of the gap between the cap body and the hollow tube body in order to achieve great tightness. In this way, the cap body and the hollow tube body can be firmly fixed with each other and greater tightness can be achieved in order to avoid that the service life of the lamp tube structure decreases because water or dust enters the lamp tube structure. Besides, in one embodiment, the glue can adhere to the rough surface on the inner surface of the cap body, such that the combination of the hollow tube body and the cap body can be more stable. Further, in one embodiment, the cap body and the hollow tube body can be more effectively and firmly fixed with each other by increasing the contact area between the glue and the inner wall of the cap body. Moreover, in one embodiment, the ribs inside the inner wall make the combination of the cap body and the hollow tube body more stable, such that the structural strength of the lamp tube structure can be further enhanced.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

The present invention will become more fully understood from the detailed description given herein below and the accompanying drawings which are given by way of illustration only, and thus are not limitative of the present invention and wherein:

FIG. 5 shows that the hollow tube body is combined with the cap body. The rough surface (the dotted lines), the glue (the points), the first protrusion portion (the bold dotted line) and the second protrusion (the bold dotted line) are also shown in FIG. 5.

FIG. 8 shows that the hollow tube body is combined with the cap body. The rough surface (the dotted lines), the glue (the points), the first protrusion portion (the bold dotted line), the second protrusion (the bold dotted line) and the ribs (the dotted lines at the center) are also shown in FIG. 8.

DETAILED DESCRIPTION

Figure 1:
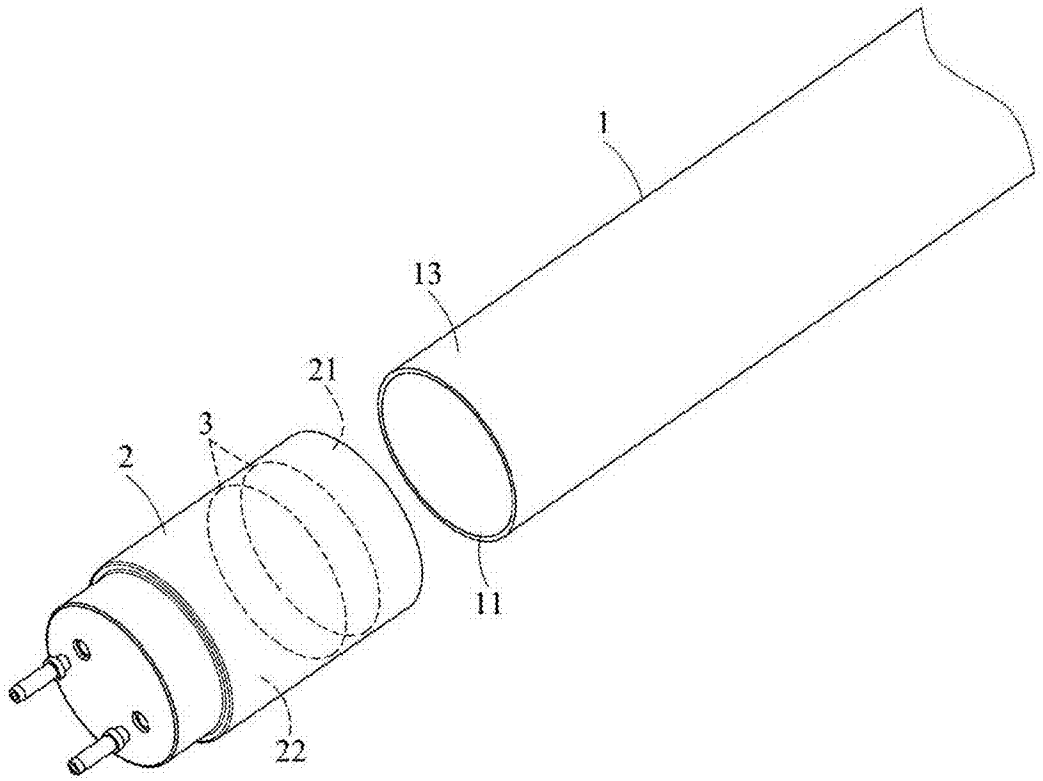
FIG. 1 is the exploded view of the lamp tube structure in accordance with one embodiment of the present invention.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing. It should be understood that, when it is described that an element is "coupled" or "connected" to another element, the element may be "directly coupled" or "directly connected" to the other element or "coupled" or "connected" to the other element through a third element. In contrast, it should be understood that, when it is described that an element is "directly coupled" or "directly connected" to another element, there are no intervening elements.

Please refer to FIG. 1, which is the exploded view of the lamp tube structure in accordance with one embodiment of the present invention. FIG. 1 shows the lamp tube structure capable of preventing glue from overflowing, which includes a hollow tube body 1 and a cap body 2.

Figure 2:
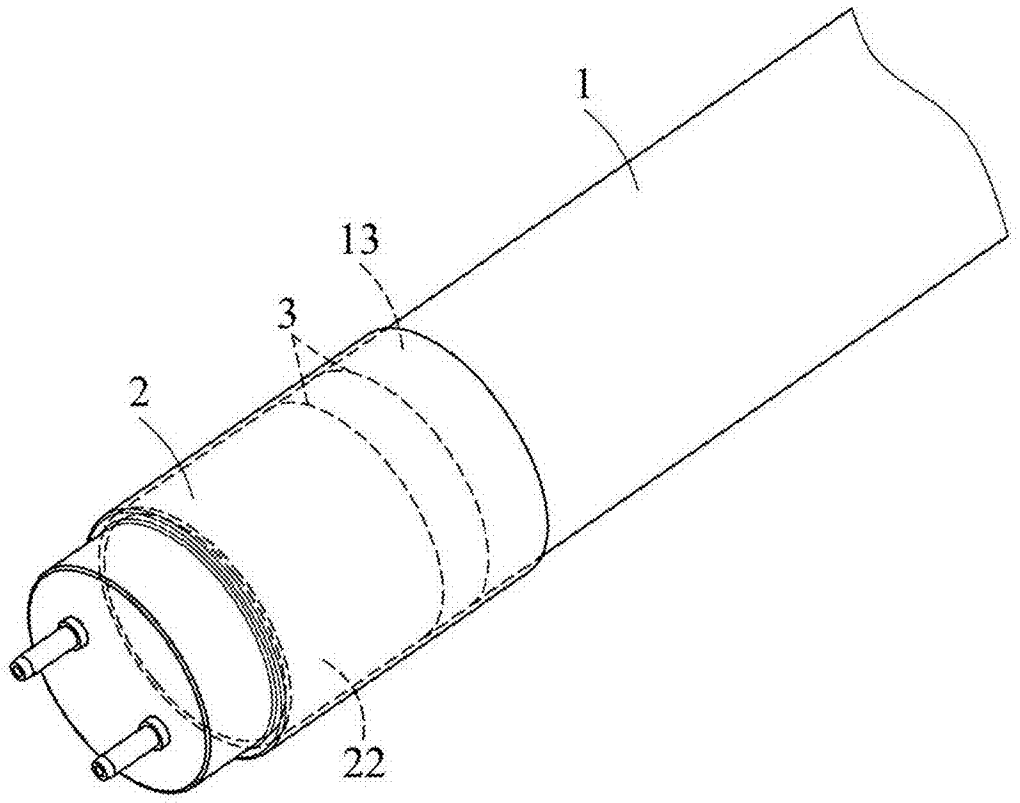
FIG. 2 is the schematic view for illustrating the appearance of the lamp tube structure in accordance with one embodiment of the present invention.

Please refer to FIG. 1 and FIG. 2. FIG. 2 is the schematic view for illustrating the appearance of the lamp tube structure in accordance with one embodiment of the present invention. In one embodiment, the lamp tube structure is a LED lamp. The hollow tube body 1 is provided with a LED module disposed therein and the cap body 2 is provided with a power source module disposed therein. The above elements are not shown in the drawings. FIG. 1 and FIG. 2 only partially show hollow tube body 1 and one of the cap bodies 2. The lamp tube structure has the hollow tube body 1 and two cap bodies 2 disposed at the two ends of the hollow tube body 1.

Figure 3:
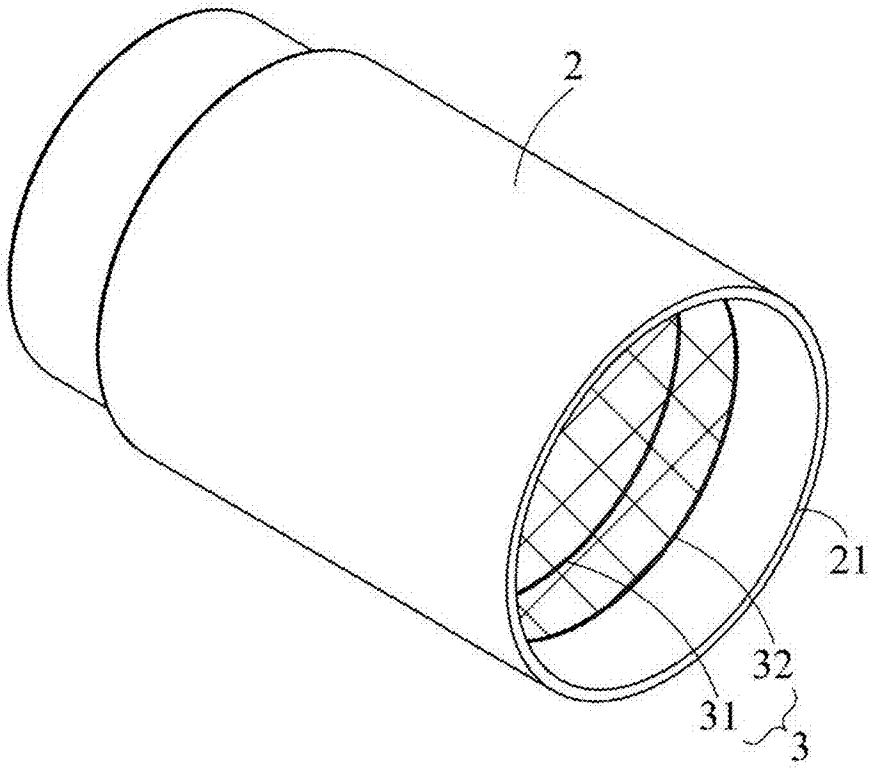
FIG. 3 is the schematic view for illustrating the appearance of the cap body of the lamp tube structure in accordance with one embodiment of the present invention.
Figure 4:
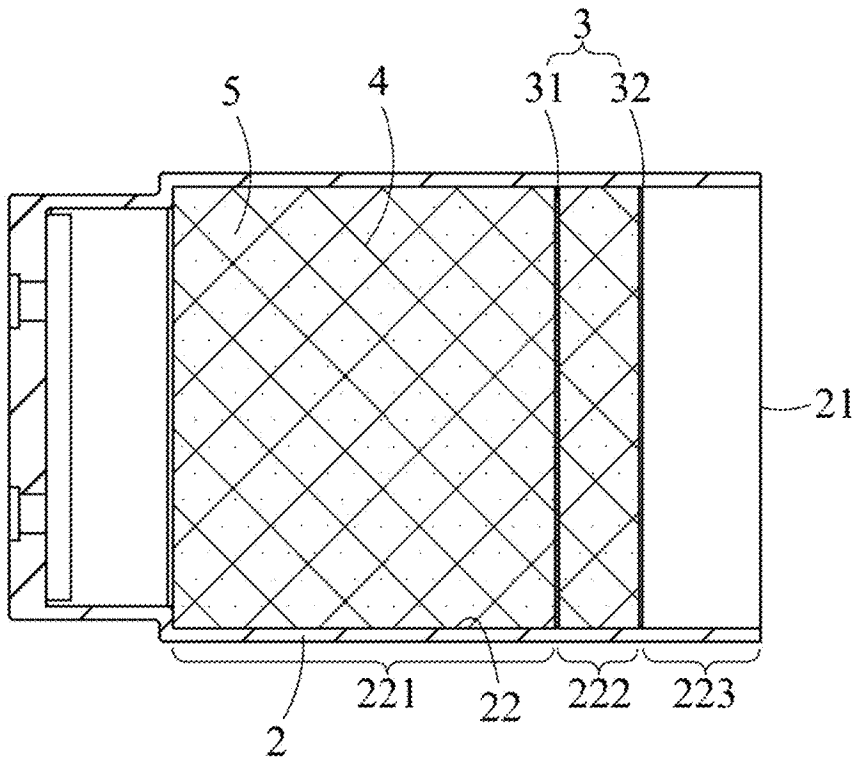
FIG. 4 is the cross-sectional view of the cap body of the lamp tube structure in accordance with one embodiment of the present invention.
Figure 5:
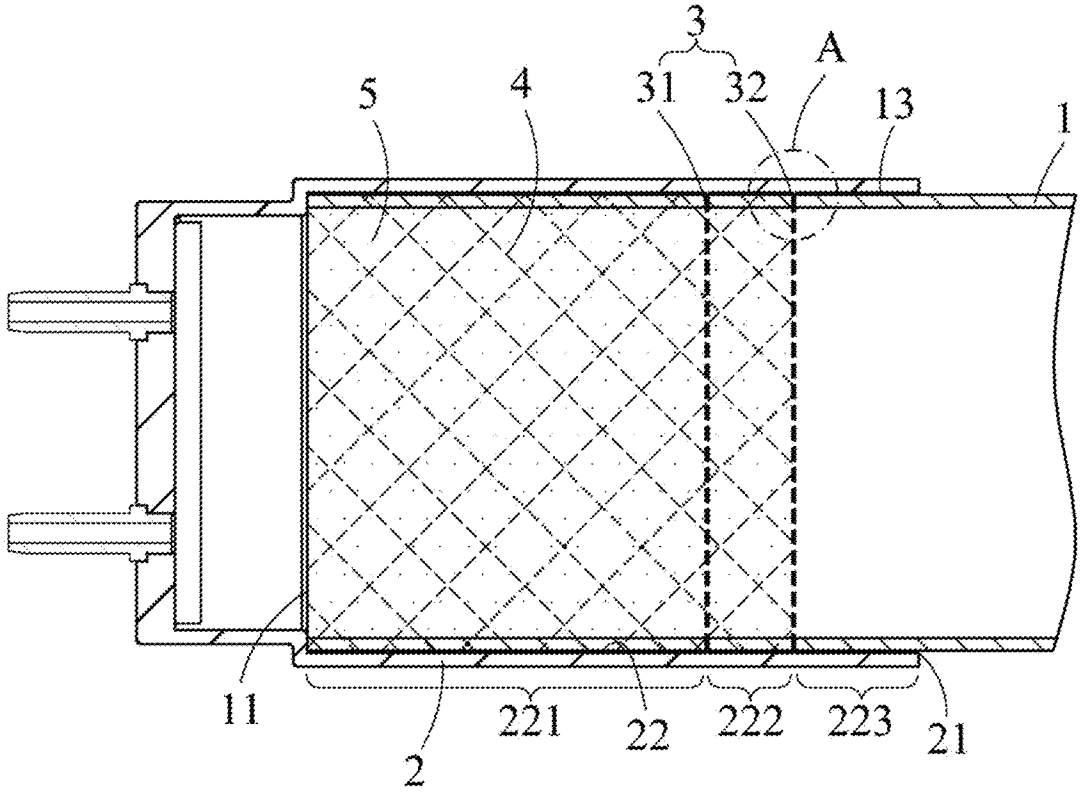
FIG. 5 is the cross-sectional view of a part of the lamp tube structure in accordance with one embodiment of the present invention.

Please refer to FIG. 1-FIG. 5. FIG. 3 is the schematic view for illustrating the appearance of the cap body 2 of the lamp tube structure in accordance with one embodiment of the present invention. FIG. 4 is the cross-sectional view of the cap body 2 of the lamp tube structure in accordance with one embodiment of the present invention. FIG. 5 is the cross-sectional view of a part of the lamp tube structure in accordance with one embodiment of the present invention. The rough surface 4 (the dotted lines), the glue 5 (the points), the first protrusion portion 31 (the bold dotted line) and the second protrusion 32 (the bold dotted line) are also shown in FIG. 5. In one embodiment, the cap body 2 covers the opening 11 of the hollow tube body 1 and the inner surface 22 of the cap body 2 are provided with a plurality of ring-shaped protrusion portions 3 arranged to be parallel with each other. The glue 5 (the points shown in FIG. 4) is distributed over the inner surface 22 of the cap body 2 and the protrusion portions 3 can prevent the glue 5 from overflowing. The outer surface 13 of the hollow tube body 1 contacts the protrusion portions 3.

Please refer to FIG. 1-FIG. 5. When the hollow tube body 1 is combined with the cap body 2, the opening 11 of the hollow tube body 1 extends into the inner space of the cap body 2 and the outer surface 13 of the hollow tube body 1 contacts the protrusion portions 3. Meanwhile, the glue 5 distributed over the inner surface 22 of the cap body 2 adheres to the outer surface 13 of the hollow tube body 1. In this case, the protrusion portions 3 can effectively avoid that the glue 5 overflows from the cap between the hollow tube body 1 and the cap body 2, so the hollow tube body 1 and the cap body 2 can be firmly fixed with each other so as to achieve greater tightness. Thus, the service life of the lamp tube structure will not be influenced because water or dust enters the inner space of the lamp tube structure.

Please refer to FIG. 1 and FIG. 2. In one embodiment, the hollow tube body 1 is a cylindrical, and may be made of glass, organic glass or other transparent polymeric materials.

Figure 6:
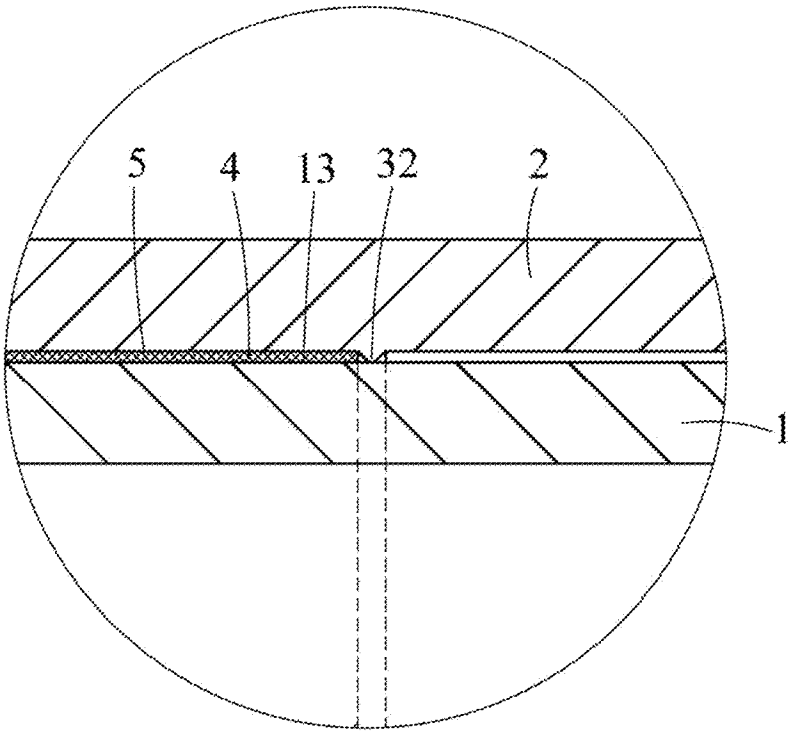
FIG. 6 is the enlarged view of the area A of FIG. 5 in accordance with one embodiment of the present invention. The second protrusion (the dotted line) is also shown in FIG. 6.

Please refer to FIG. 4 and FIG. 5. In one embodiment, the protrusion portions 3 include a first protrusion portion 31 and a second protrusion portion 32. The protrusion portions 3 contact the outer surface 13 of the hollow tube body 1, which can completely prevent the glue 5 from overflowing. If the glue 5 overflows from the first protrusion portion 31, the second protrusion portion 32 can prevent the glue 5 between the first protrusion portion 31 and the second protrusion portion 32 from overflowing (as shown in FIG. 6). Therefore, the above structure can effectively avoid that the glue 5 overflows out of the opening 21 of the cap body 2. Further, the protrusion portions 3 can make the glue 5 between the bottom of the cap body 2 and the first protrusion portion 31 completely contact the cap body 2 and the hollow tube body 1. The first protrusion portion 31 is disposed at the inner surface 22 of the cap body 2 to form a circle. The second protrusion portion 32 is also disposed at the inner surface 22 of the cap body 2 to form a circle. The cross-sections of the first protrusion portion 31 and the second protrusion portion 32 may be conical; in another embodiment, the cross-sections of the first protrusion portion 31 and the second protrusion portion 32 may also be semicircular. The inside diameter of the first protrusion portion 31 may be equal to or unequal to that of the second protrusion portion 32.

In one embodiment, each of the protrusion portions 3 (or baffle plate) may be ribs, prominent strips, etc. The protrusion portions 3 and the cap body 2 are integrally formed or independent elements.

Please refer to FIG. 4, in one embodiment, the protrusion portions 3 are arranged to be parallel with each other and disposed at the inner surface 22 of the cap body 2.

Please refer to FIG. 4 and FIG. 5. In one embodiment, the protrusion portions 3 are disposed to be adjacent to the opening 21 of the cap body 2. The inner surface 22 of the cap body 2 includes a plurality of areas, which includes a first area, a second area and a third area. The first area 221 is between the first protrusion portion 31 and the bottom of the inner space of the cap body 2. The second area 222 is between the first protrusion portion 31 and the second protrusion portion 32. The third area 223 is between the opening 21 of the cap body 2 and the second protrusion portion 32.

Please refer to FIG. 4 and FIG. 5. In one embodiment, there is a first distance between the first protrusion portion 31 and the bottom of the inner space of the cap body 2. There is a second distance between the second protrusion portion 32 and the first protrusion portion 31. The first distance is greater than the second distance.

Please refer to FIG. 4 and FIG. 5. In one embodiment, there is a third distance between the opening 21 of the cap body 2 and the second protrusion portion 32. The third distance is greater than the second distance.

Please refer to FIG. 4 and FIG. 5. In one embodiment, the inner surface 22 of the cap body 2 is provided with the rough surface 3 and the glue 5 adheres to the rough surface 4. The mesh lines shown in FIG. 4 stand for the rough surface 4 inside the cap body 2. The cap body 2 is combined with the hollow tube body 1 via the rough surface 4, which can enhance the adhesion of the glue adhering to the rough surface 4. Therefore, the hollow tube body 1 can be more stably fixed with the cap body 2.

Please refer to FIG. 4 and FIG. 5. In one embodiment, the rough surface is distributed over the first area 221 and the second area 222. The rough surface 4 may include many concave and convex structures. For example, the rough surface 4 may include many concave and convex points, lines or blocks arranged to form a matrix.

Figure 7:
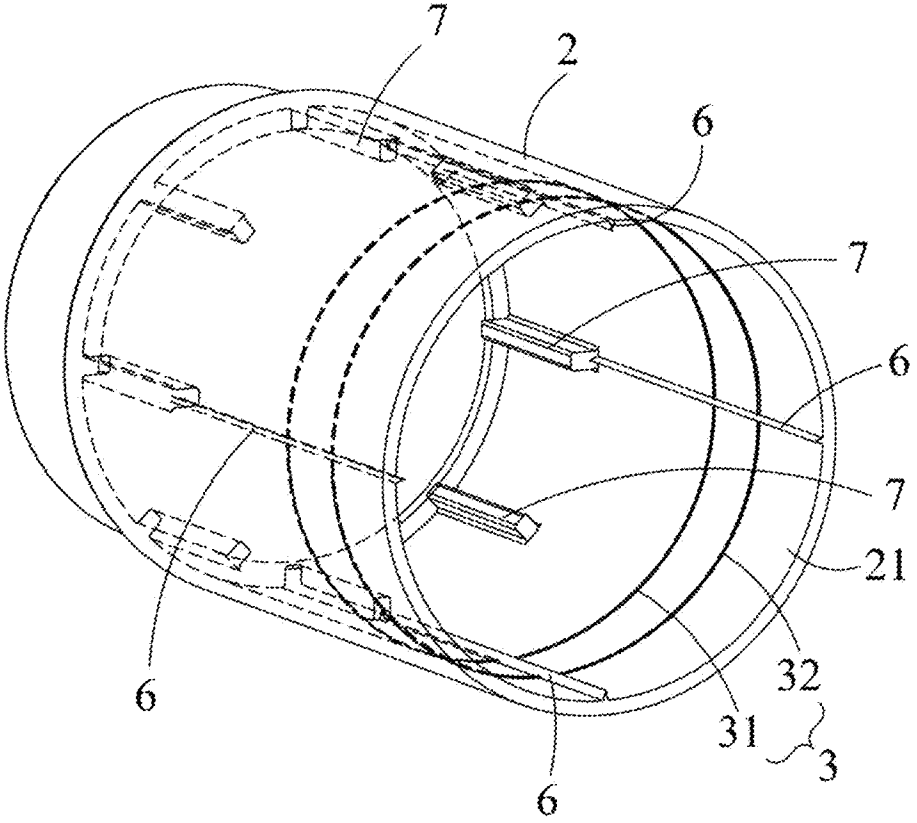
FIG. 7 is another schematic view for illustrating the appearance of the cap body of the lamp tube structure in accordance with one embodiment of the present invention. The ribs disposed at the inner wall of the cap body are shown in FIG. 7.
Figure 8:
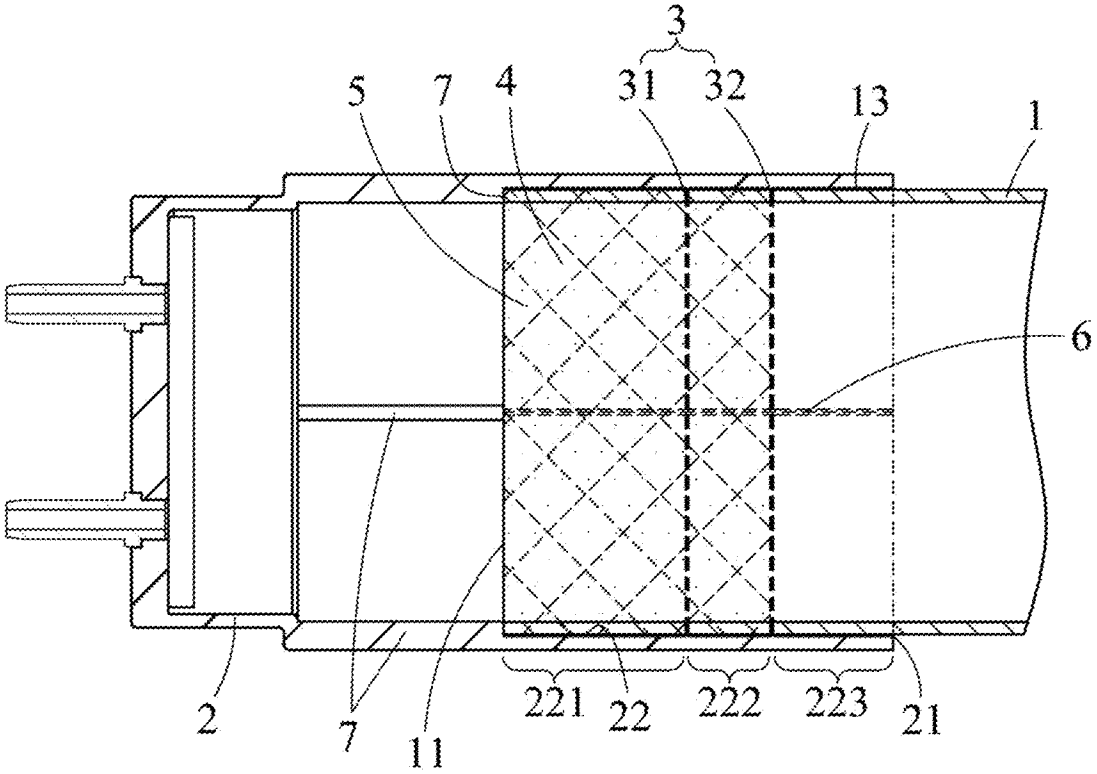
FIG. 8 is another cross-sectional view of a part of the lamp tube structure in accordance with one embodiment of the present invention.

Please refer to FIG. 7 and FIG. 8. FIG. 7 is another schematic view for illustrating the appearance of the cap body of the lamp tube structure in accordance with one embodiment of the present invention, which shows that there are several ribs disposed at the inner wall of the cap body. FIG. 8 is another cross-sectional view of a part of the lamp tube structure in accordance with one embodiment of the present invention, which shows that the hollow tube body is combined with the cap body. The rough surface (the dotted lines), the glue (the points), the first protrusion portion (the bold dotted line), the second protrusion (the bold dotted line) and the ribs (the dotted lines at the center) are also shown in FIG. 8. In one embodiment, the inner wall of the lamp cap 2 is provided with a plurality of ribs 6 and the outer surface 13 of the hollow tube body 1 contacts the ribs 6. In one embodiment, the quantity of the ribs 6 may be, but not limited to, 4. In another embodiment, the quantity of the ribs 6 may be 2, 4, 5 or 6.

When the size of the hollow tube body 1 is small, the ribs 6 of the cap body 2 can effectively contact the hollow tube body 1 after the hollow tube body 1 is inserted into the cap body 2. The above structure can make sure that there is no non-uniform gap between the cap body 2 and the hollow tube body 1, such that the cap body 2 can be more stably combined with the hollow tube body 1 and the hollow tube body 1 can be in line with the cap body 2 without tilting. When the size of the hollow tube body 1 is large, the hollow tube body 1 presses the ribs 6 after the hollow tube body 1 is inserted into the cap body 2 (the ribs 6 may be deformed or disappear when an external force is applied thereto). The above structure can make sure that there is no non-uniform gap between the cap body 2 and the hollow tube body 1, such that the cap body 2 can be more stably combined with the hollow tube body 1 and the hollow tube body 1 can be in line with the cap body 2 without tilting.

Please refer to FIG. 7 and FIG. 8. In one embodiment, the inner wall of the cap body 2 is provided with a plurality of positioning blocks 7 and the outer wall of the opening 11 of the hollow tube body 1 contacts one side of each positioning block 7 so as to fix the position of the hollow tube body 1. In one embodiment, the quantity of the positioning blocks 7 may be, but not limited to, 8. In another embodiment, the quantity of the positioning blocks 7 may be 2, 3, 5 or 6.

In one embodiment, the protrusion portions inside the cap body can prevent the glue from overflowing out of the gap between the cap body and the hollow tube body in order to achieve great tightness. In this way, the cap body and the hollow tube body can be firmly fixed with each other and greater tightness can be achieved in order to avoid that the service life of the lamp tube structure decreases because water or dust enters the lamp tube structure. Besides, in one embodiment, the glue can adhere to the rough surface on the inner surface of the cap body, such that the combination of the hollow tube body and the cap body can be more stable. Further, in one embodiment, the cap body and the hollow tube body can be more effectively and firmly fixed with each other by increasing the contact area between the glue and the inner wall of the cap body. Moreover, in one embodiment, the ribs inside the inner wall make the combination of the cap body and the hollow tube body more stable, such that the structural strength of the lamp tube structure can be further enhanced.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A lamp tube structure capable of preventing glue from overflowing, comprising a hollow tube body and a cap body covering an opening of the hollow tube body, wherein an inner surface of the cap body is provided with a plurality of protrusion portions, and the protrusion portions are ring-shaped and arranged to be parallel with each other, wherein a glue is distributed over the inner surface of the cap body and the protrusion portions are configured to prevent the glue from overflowing, and an outer surface of the hollow tube body contacts the protrusion portions, wherein the protrusion portions include a first protrusion portion and a second protrusion portion, and the first protrusion portion and the second protrusion portion are circular and cross-sections of the first protrusion portion and the second protrusion portion are conical.

2. The lamp tube structure capable of preventing glue from overflowing as claimed in claim 1, wherein the protrusion portions include a first protrusion portion and a second protrusion portion, wherein there is a first area between the first protrusion portion and a bottom of an inner space of the cap body, there is a second area between the first protrusion portion and the second protrusion portion, and there is a third area between an opening of the cap body and the second protrusion portion.

3. The lamp tube structure capable of preventing glue from overflowing as claimed in claim 2, wherein there is a first distance between the first protrusion portion and the bottom of the inner space of the cap body, there is a second distance between the second protrusion portion and the first protrusion portion, wherein the first distance is greater than the second distance.

4. The lamp tube structure capable of preventing glue from overflowing as claimed in claim 3, wherein there is a third distance between the opening of the cap body and the second protrusion portion, and the third distance is greater than the second distance.

5. The lamp tube structure capable of preventing glue from overflowing as claimed in claim 4, wherein the rough surface is distributed over the first area and the second area.

6. The lamp tube structure capable of preventing glue from overflowing as claimed in claim 1, wherein the protrusion portions are adjacent to an opening of the cap body.

7. The lamp tube structure capable of preventing glue from overflowing as claimed in claim 6, wherein the inner surface of the cap body is provided with a rough surface and the glue adheres to the rough surface.

8. The lamp tube structure capable of preventing glue from overflowing as claimed in claim 1, wherein an inner wall of the lamp cap is provided with a plurality of ribs and the outer surface of the hollow tube body contacts the ribs.

9. The lamp tube structure capable of preventing glue from overflowing as claimed in claim 1, wherein an inner wall of the lamp cap is provided with a plurality of positioning blocks and an outer wall of the opening of the hollow tube body contacts the positioning blocks.

* * * * *